US009053693B1

(12) United States Patent
Wei

(10) Patent No.: US 9,053,693 B1
(45) Date of Patent: Jun. 9, 2015

(54) DIGITAL CYMBAL DISPLACEMENT CONTROL DEVICE FOR ELECTRONIC CYMBAL

(71) Applicant: AI-Musics Technology Inc., New Taipei (TW)

(72) Inventor: Gwo-Hsiung Wei, New Taipei (TW)

(73) Assignee: AI-MUSICS TECHNOLOGY INC., New Taipei (TW)

( * ) Notice: Subject to any disclaimer, the term of this patent is extended or adjusted under 35 U.S.C. 154(b) by 0 days.

(21) Appl. No.: 14/149,797

(22) Filed: Jan. 7, 2014

(51) Int. Cl.

| | |
|---|---|
| ***G10H 3/14*** | (2006.01) |
| ***G10H 3/00*** | (2006.01) |
| ***G10H 1/00*** | (2006.01) |
| ***G10H 1/18*** | (2006.01) |
| ***G10H 3/18*** | (2006.01) |
| ***G10H 1/34*** | (2006.01) |
| ***G10H 1/32*** | (2006.01) |
| ***G10D 13/02*** | (2006.01) |
| ***G10D 13/06*** | (2006.01) |

(52) U.S. Cl.
CPC ..... *G10H 3/146* (2013.01); *G10D 13/065* (2013.01); *G10H 3/00* (2013.01); *G10H 1/34* (2013.01); *G10H 1/32* (2013.01); *G10D 13/02* (2013.01); *G10H 1/348* (2013.01); *G10H 1/00* (2013.01); *G10H 3/18* (2013.01); *G10D 13/06* (2013.01)

(58) Field of Classification Search
CPC ..... G10H 3/18; G10H 1/00; G10H 3/00; G10H 1/32; G10H 1/34; G10H 1/348; G10H 3/146; G10D 13/02; G10D 13/06
USPC ..... 84/723, 422.3, 615, 411 R, 746
See application file for complete search history.

(56) References Cited

U.S. PATENT DOCUMENTS

| | | | | |
|---|---|---|---|---|
| 4,381,690 | A * | 5/1983 | Kimble | 84/422.3 |
| 4,497,238 | A * | 2/1985 | Dasovich | 84/421 |
| 5,262,585 | A * | 11/1993 | Greene et al. | 84/645 |
| 5,915,289 | A * | 6/1999 | Hart | 84/738 |
| 5,965,834 | A * | 10/1999 | Suenaga et al. | 84/422.3 |
| 6,417,434 | B1 * | 7/2002 | Lao | 84/422.3 |
| 6,822,148 | B2 * | 11/2004 | Yanase | 84/422.1 |
| 7,294,778 | B2 * | 11/2007 | Susami | 84/723 |
| 7,468,483 | B2 * | 12/2008 | Yoshino | 84/723 |
| 7,473,834 | B2 * | 1/2009 | Yoshino | 84/402 |
| 7,560,638 | B2 * | 7/2009 | Susami | 84/723 |
| 7,820,903 | B2 * | 10/2010 | Susami | 84/615 |
| 7,943,841 | B2 * | 5/2011 | Toda | 84/422.3 |
| 8,344,235 | B2 * | 1/2013 | Steele | 84/615 |
| 8,723,014 | B2 * | 5/2014 | Susami | 84/723 |
| 8,742,244 | B2 * | 6/2014 | Wissmuller | 84/723 |
| 8,785,758 | B2 * | 7/2014 | Wissmuller | 84/615 |

(Continued)

*Primary Examiner* — David Warren
*Assistant Examiner* — Christina Schreiber
(74) *Attorney, Agent, or Firm* — Han IP Corporation

(57) ABSTRACT

Embodiments of a digital cymbal displacement control device for an electronic hi-hat are provided. A digital cymbal displacement detection unit in accordance with the present disclosure is configured to be directly mounted on the tube above the stand of an electronic hi-hat, as with any conventional hi-hat, without any need of changing the way how the electronic hi-hat is operated. The digital cymbal displacement detection unit includes at least one displacement detection unit and a plurality of sliding elastic elements that slide along a contact surface of the at least one displacement detection unit. Variation in an electrical parameter of each of the at least one displacement detection unit is utilized to determine the displacement of an electronic cymbal set of the electronic hi-hat.

20 Claims, 13 Drawing Sheets

(56) References Cited

U.S. PATENT DOCUMENTS

| | | | | |
|---|---|---|---|---|
| 2002/0059861 | A1* | 5/2002 | Yoshino et al. | 84/402 |
| 2003/0200860 | A1* | 10/2003 | Toda | 84/746 |
| 2005/0145101 | A1* | 7/2005 | Yoshino | 84/723 |
| 2006/0096448 | A1* | 5/2006 | Yoshino et al. | 84/734 |
| 2006/0156910 | A1* | 7/2006 | Yoshino | 84/723 |
| 2012/0118130 | A1* | 5/2012 | Field | 84/730 |
| 2014/0096664 | A1* | 4/2014 | Nakata et al. | 84/422.3 |

* cited by examiner

300

CLUTCH ASSEMBLY 200 IN
RELATION TO ELECTRONIC CYMBAL
SET 100

DIGITAL CYMBAL DISPLACEMENT CONTROL DEVICE FOR ELECTRONIC CYMBAL

BACKGROUND

1. Technical Field

The present disclosure relates to the field of electronic musical instruments and, more particularly, to electronic percussion instruments.

2. Description of the Related Art

Cymbals are a common percussion instrument. Cymbals typically consist of thin, normally round plates of various alloys. There are various types of cymbals, including hi-hats.

A hi-hat, or hihat, is a type of cymbal and stand used as a typical part of a drum kit by percussionists in various forms of contemporary popular music, and is a standard part of the modern drum kit. A hi-hat typically consists of two cymbals that are mounted on a stand, one on top of the other (and hence the two cymbals consists of a top cymbal and a bottom cymbal), and a pedal which can be used to clash and hold the cymbals together. The pedal is usually directly below the cymbals, which are supported by a hollow vertical tube. The top cymbal is mounted horizontal and bell up, while an adjustment screw allows the bottom cymbal to be either horizontal or slightly tilted. A narrow metal shaft or pull rod runs through the top and bottom cymbals as well as the tube, and connects to the pedal. The top cymbal is connected to the pull rod with a clutch or clutch assembly, and can be lowered by operating the pedal against a spring which holds it up in the "open" position, while the bottom cymbal remains stationary. The height of the top cymbal with the pedal released is typically adjustable by varying the position of the clutch assembly on the pull rod. When the cymbals are closed, the pressure holding them together can be varied by varying the foot pressure.

When the foot plate of the pedal is pressed, the top cymbal crashes onto the bottom cymbal (a state known as closed hi-hat). When the foot plate of the pedal is released, the top cymbal returns to its original position above the bottom cymbal (a state known as open hi-hat). Tension of the spring controls the amount of pressure required to lower the top cymbal, as well as how fast the top cymbal returns to its open position, and can also be varied.

There are several patterns of clutch assembly used to support the top cymbal, but the most common uses a knurled collar that is part threaded below the cymbal, and a pair of knurled rings above it. The collar is tightened against the end of the thread, while the rings are tightened against each other.

SUMMARY

This section highlights a select number of embodiments as non-limiting illustrative examples of implementation of the inventive concept of the present disclosure. Accordingly, the scope of the claims in the present application is not limited to embodiments presented herein. Unless otherwise indicated herein, embodiments described in this section are not prior art to the claims in the present application and are not admitted to be prior art by inclusion in this section.

In one aspect, a digital cymbal displacement control device configured to measure a displacement of an electronic cymbal set of an electronic hi-hat is provided. The digital cymbal displacement control device may include a base unit, an elastic element, a sliding seat, a plurality of sliding elastic elements and at least one displacement detection unit. The base unit may include a base, a sliding neck and a plurality of sliding guide posts. The sliding neck may protrude from a central portion of primary side of the base along a vertical axis of the device and may include a through-hole that traverses through the sliding neck along the vertical axis of the device. The sliding guide posts may be disposed along a periphery of the primary side of the base and may protrude from the primary side of the base along the vertical axis of the device. Each of the sliding guide posts may include a groove extending along the vertical axis of the device and facing the sliding neck. The elastic element may be disposed on the primary side of the base of the base unit and may encircle the sliding neck of the base unit. The sliding seat may include a through-hole configured to allow the sliding seat to encircle the sliding neck of the base such that the sliding seat slides along the sliding neck of the base unit in response to a balance between forces from the elastic element and the electronic cymbal set of the electronic hi-hat. The sliding elastic elements may be disposed around a side surface of the sliding seat. Each of the at last one displacement detection unit may be disposed in the groove of a respective one of the sliding guideposts of the base unit such that, in response to the sliding seat sliding along the sliding neck of the base unit, each of the sliding elastic elements movably contacts a contact surface of a respective one of the at least one displacement detection unit to cause variation in an electrical parameter of the respective displacement detection unit, the variation in the electrical parameter representative of a displacement of the electronic cymbal set.

In one embodiment, each of the sliding elastic elements may be received in the groove of a respective one of the sliding guide posts of the base unit such that the sliding seat is prevented from spinning axially around the vertical axis.

In one embodiment, at least one of the sliding elastic elements may include a steel plate configured to spring elastically between the sliding seat and the respective one of the at least one displacement detection unit.

In one embodiment, the sliding guide posts of the base unit may include three sliding guide posts that are disposed 120° apart from each other axially around the sliding neck.

In one embodiment, the elastic element may include a wave spring or a coil spring.

In one embodiment, at least one of the at least one displacement detection unit may include a sheet sensor having the contact surface with which a respective one of the sliding elastic elements contacts.

In one embodiment, the sheet sensor may include: a top layer constituting the contact surface of the sheet sensor; a bottom layer; and a spacer disposed between the top layer and a bottom layer such that a first portion of the top layer and a first portion of the bottom layer are in direct contact with each other while a second portion of the top layer and a second portion of the bottom layer are separated from each other by the spacer.

In one embodiment, the spacer may include a plurality of spacer particles.

In one embodiment, the top layer may include an electrically-conductive pattern such that an electrical parameter of the electrically-conductive pattern varies in response to the respective sliding elastic element sliding along the top layer.

In one embodiment, the digital cymbal displacement control device may further include a circuit board configured to determine the displacement of the electronic cymbal set based at least in part on the variation in the electrical parameter of each of the at least one displacement detection unit.

In one embodiment, the digital cymbal displacement control device may further include an outer cover having a hollow herein. The outer cover may be configured to contain the sliding seat, the sliding guide posts of the base unit and the at least one displacement detection unit in the hollow when the outer cover is disposed on the primary side of the base of the base unit.

In one embodiment, the digital cymbal displacement control device may further include an anti-vibration element disposed on the outer cover at a distal end of the device opposite the base of the base unit. The anti-vibration element may be configured to minimize vibration of the electronic cymbal set when the electronic cymbal set comes in contact with the anti-vibration element.

In one embodiment, the anti-vibration element may be made of rubber and may include a plurality of grooves on a surface that faces the electronic cymbal set.

In one embodiment, the digital cymbal displacement control device may further include: a first shock absorption element disposed between the base unit and the sliding seat; a second shock absorption element looping around a protrusion of the sliding seat and disposed on a shoulder of the sliding seat; and a third shock absorption element disposed atop the protrusion of the sliding seat as a point of contact with a clutch assembly of the electronic hi-hat.

In another aspect, an electronic hi-hat is provided. The electronic hi-hat may include: a tube having a hollow therein; a pull rod traversing through the hollow of the tube; an electronic cymbal set having a through-hole therein such that the pull rod traverses through the through-hole of the electronic cymbal set; a clutch assembly configured to fasten the electronic cymbal set to the pull rod; and a digital cymbal displacement control device disposed at a distal end of the tube and having a through-hole such that the pull rod traverses through the through-hole of the digital cymbal displacement control device. The through-hole may have a non-round shape such that the clutch assembly traverses through the through-hole and is prevented by the through-hole from spinning axially around a vertical axis of the device.

The digital cymbal displacement control device may include a base unit, an elastic element, a sliding seat, a plurality of sliding elastic elements and at least one displacement detection unit. The base unit may include a base, a sliding neck and a plurality of sliding guide posts. The sliding neck may protrude from a central portion of primary side of the base along the vertical axis and may include a through-hole that traverses through the sliding neck along the vertical axis of the device. The sliding guide posts may be disposed along a periphery of the primary side of the base and may protrude from the primary side of the base along the vertical axis of the device. Each of the sliding guide posts may include a groove extending along the vertical axis of the device and facing the sliding neck. The elastic element may be disposed on the primary side of the base of the base unit and may encircle the sliding neck of the base unit. The sliding seat may include a through-hole configured to allow the sliding seat to encircle the sliding neck of the base such that the sliding seat slides along the sliding neck of the base unit in response to a balance between forces from the elastic element and the electronic cymbal set of the electronic hi-hat. The sliding elastic elements may be disposed around a side surface of the sliding seat. Each of the at least one displacement detection unit may be disposed in the groove of a respective one of the sliding guideposts of the base unit such that, in response to the sliding seat sliding along the sliding neck of the base unit, each of the sliding elastic elements movably contacts a contact surface of a respective one of the at least one displacement detection unit to cause variation in an electrical parameter of the respective displacement detection unit, the variation in the electrical parameter representative of a displacement of the electronic cymbal set.

In one embodiment, each of the sliding elastic elements may be received in the groove of a respective one of the sliding guide posts of the base unit such that the sliding seat is prevented from spinning axially around the vertical axis.

In one embodiment, at least one of the sliding elastic elements may include a steel plate configured to spring elastically between the sliding seat and the respective one of the at least one displacement detection unit.

In one embodiment, the sliding guide posts of the base unit may include three sliding guide posts that are disposed 120° apart from each other axially around the sliding neck.

In one embodiment, the elastic element may include a wave spring or a coil spring.

In one embodiment, at least one of the at least one displacement detection unit may include a sheet sensor having the contact surface with which a respective one of the sliding elastic elements contacts.

In one embodiment, the sheet sensor may include: a top layer constituting the contact surface of the sheet sensor; a bottom layer; and a spacer disposed between the top layer and a bottom layer such that a first portion of the top layer and a first portion of the bottom layer are in direct contact with each other while a second portion of the top layer and a second portion of the bottom layer are separated from each other by the spacer.

In one embodiment, the spacer may include a plurality of spacer particles.

In one embodiment, the top layer may include an electrically-conductive pattern such that an electrical parameter of the electrically-conductive pattern varies in response to the respective sliding elastic element sliding along the top layer.

In one embodiment, the digital cymbal displacement control device may further include a circuit board configured to determine the displacement of the electronic cymbal set based at least in part on the variation in the electrical parameter of each of the at least one displacement detection unit.

In one embodiment, the digital cymbal displacement control device may further include an outer cover having a hollow herein. The outer cover may be configured to contain the sliding seat, the sliding guide posts of the base unit and the at least one displacement detection unit in the hollow when the outer cover is disposed on the primary side of the base of the base unit.

In one embodiment, the digital cymbal displacement control device may further include an anti-vibration element disposed on the outer cover at a distal end of the device opposite the base of the base unit. The anti-vibration element may be configured to minimize vibration of the electronic cymbal set when the electronic cymbal set comes in contact with the anti-vibration element.

In one embodiment, the anti-vibration element may be made of rubber and may include a plurality of grooves on a surface that faces the electronic cymbal set.

In one embodiment, the digital cymbal displacement control device may further include: a first shock absorption element disposed between the base unit and the sliding seat; a second shock absorption element looping around a protrusion of the sliding seat and disposed on a shoulder of the sliding seat; and a third shock absorption element disposed atop the protrusion of the sliding seat as a point of contact with a clutch assembly of the electronic hi-hat.

BRIEF DESCRIPTION OF THE DRAWINGS

The accompanying drawings are included to aid further understanding of the present disclosure, and are incorporated in and constitute a part of the present disclosure. The drawings illustrate a select number of embodiments of the present disclosure and, together with the detailed description below, serve to explain the principles of the present disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED EMBODIMENTS

Overview

A digital cymbal displacement control device in accordance with the present disclosure is configured to be directly mounted on the tube above the stand of an electronic hi-hat, as with any conventional hi-hat, without any need of changing the way how the electronic hi-hat is operated. Rather than having a top cymbal and a bottom cymbal, the electronic hi-hat has an electronic cymbal set, in lieu of the top cymbal, which moves up and down to make contact with the digital cymbal displacement control device to cause cymbal sound to be electronically generated.

The digital cymbal displacement control device is mounted at the top end of the tube of the electronic hi-hat, and is disposed between a clutch screw nut of the clutch assembly and the tube. The digital cymbal displacement control device is stationary with the pull rod freely moves up and down through a center opening of the digital cymbal displacement control device. When the electronic cymbal set, along with the clutch assembly, moves downward as a result of the foot plate of the pedal being pressed to cause the pull rod to slide downward through the digital cymbal displacement control device, the clutch screw nut pushes a sliding seat of the digital cymbal displacement control device to move downward. As the sliding seat moves downward a sensing mechanism of the digital cymbal displacement control device detects or otherwise determines the amount of displacement of the electronic cymbal set by measuring a variation in an electrical parameter, e.g., a value in resistance or capacitance.

The digital cymbal displacement control device includes an elastic element, e.g., a wave spring or coil spring, such that when the foot plate of the pedal is released the elastic element exerts a force on the sliding seat to push the sliding seat, and therefore the clutch assembly and the electronic cymbal set, to move upward. Thus, by varying the amount the foot plate of the pedal is pressed, the electronic cymbal set moves up and down and its displacement is thereby sensed, detected or otherwise measured.

The digital cymbal displacement control device is designed with an anti-spinning feature therein to prevent the spinning thereof around a vertical axis of the electronic hi-hat. Additionally, the electronic cymbal set and the clutch assembly are each designed with an anti-spinning feature therein to prevent the spinning of the electronic cymbal set from spinning around the vertical axis of the electronic hi-hat.

Example Embodiments

Figure 1:
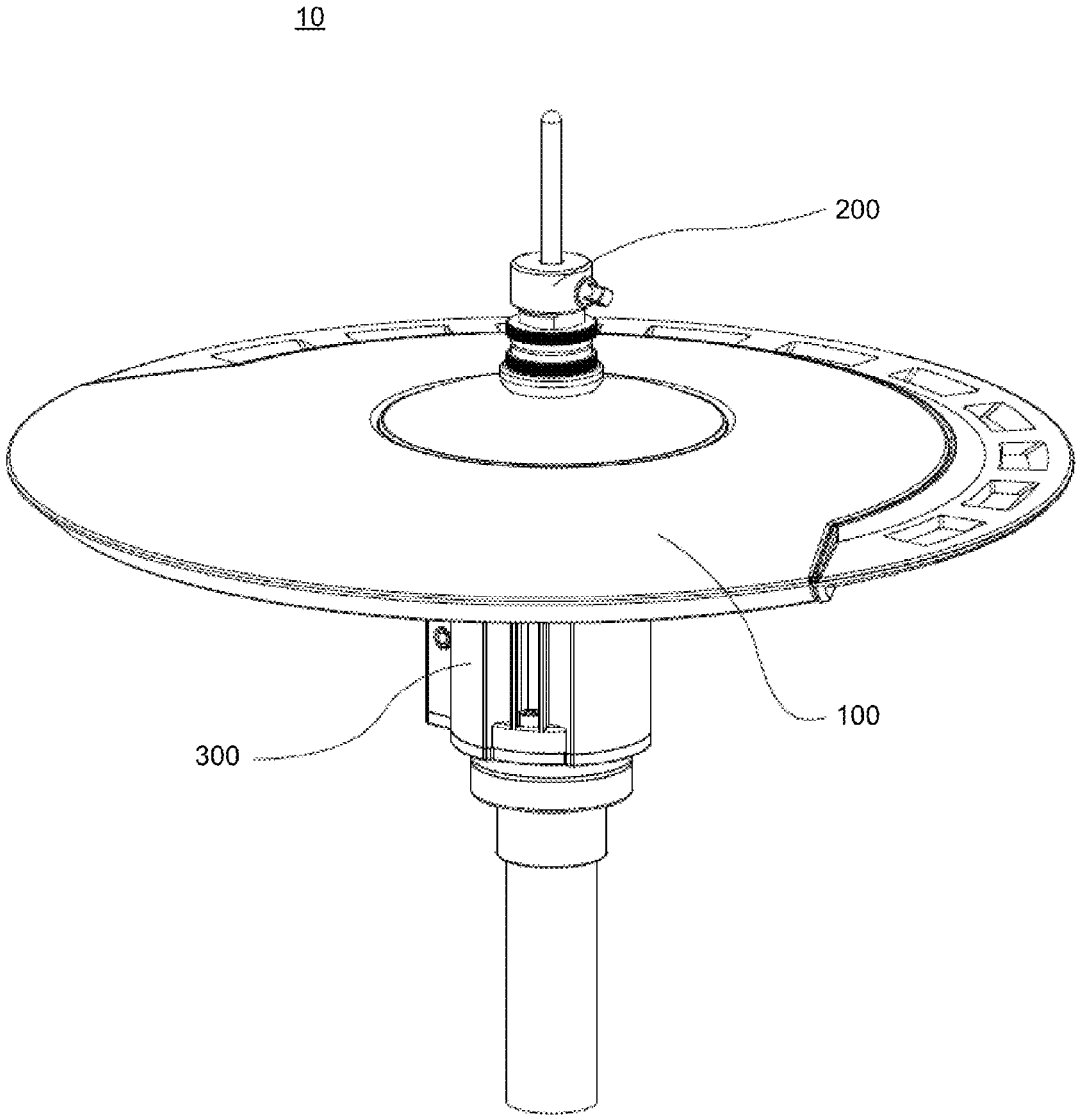
FIG. 1 is a perspective view of an upper section of an electronic hi-hat in accordance with an embodiment of the present disclosure.
Figure 2:
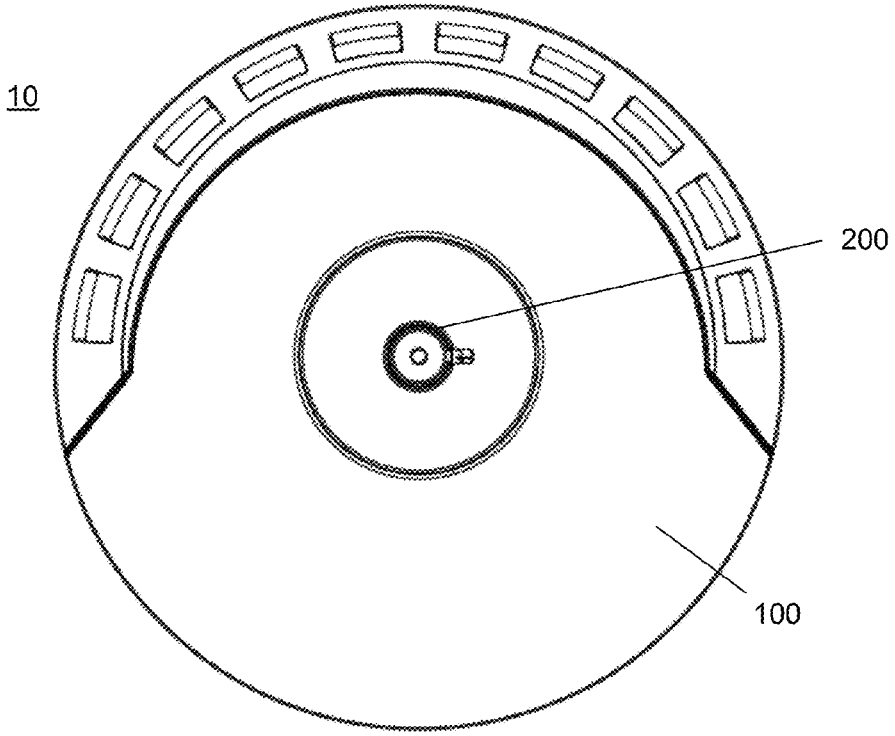
FIG. 2 is a top view of the upper section of the electronic hi-hat of FIG. 1.
Figure 3:
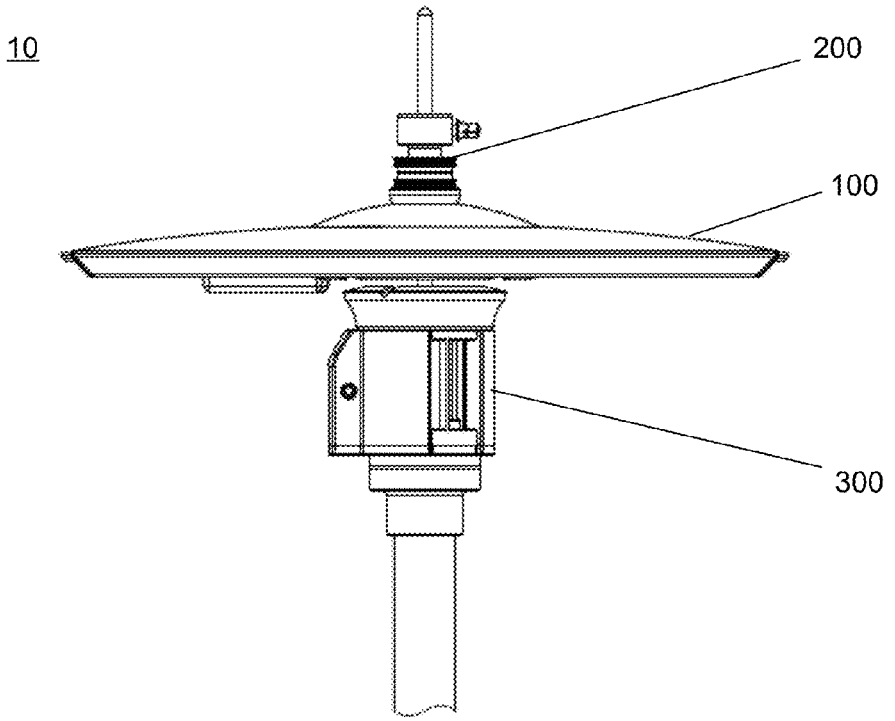
FIG. 3 is a side view of the upper section of the electronic hi-hat of FIG. 1.

FIGS. 1-3 illustrate various views of an upper section of an electronic hi-hat 10 in accordance with an embodiment of the present disclosure. As shown in FIGS. 1-3, the electronic hi-hat includes, among other components, an electronic cymbal set 100, a clutch assembly 200 and a digital cymbal displacement control device 300.

Figure 4:
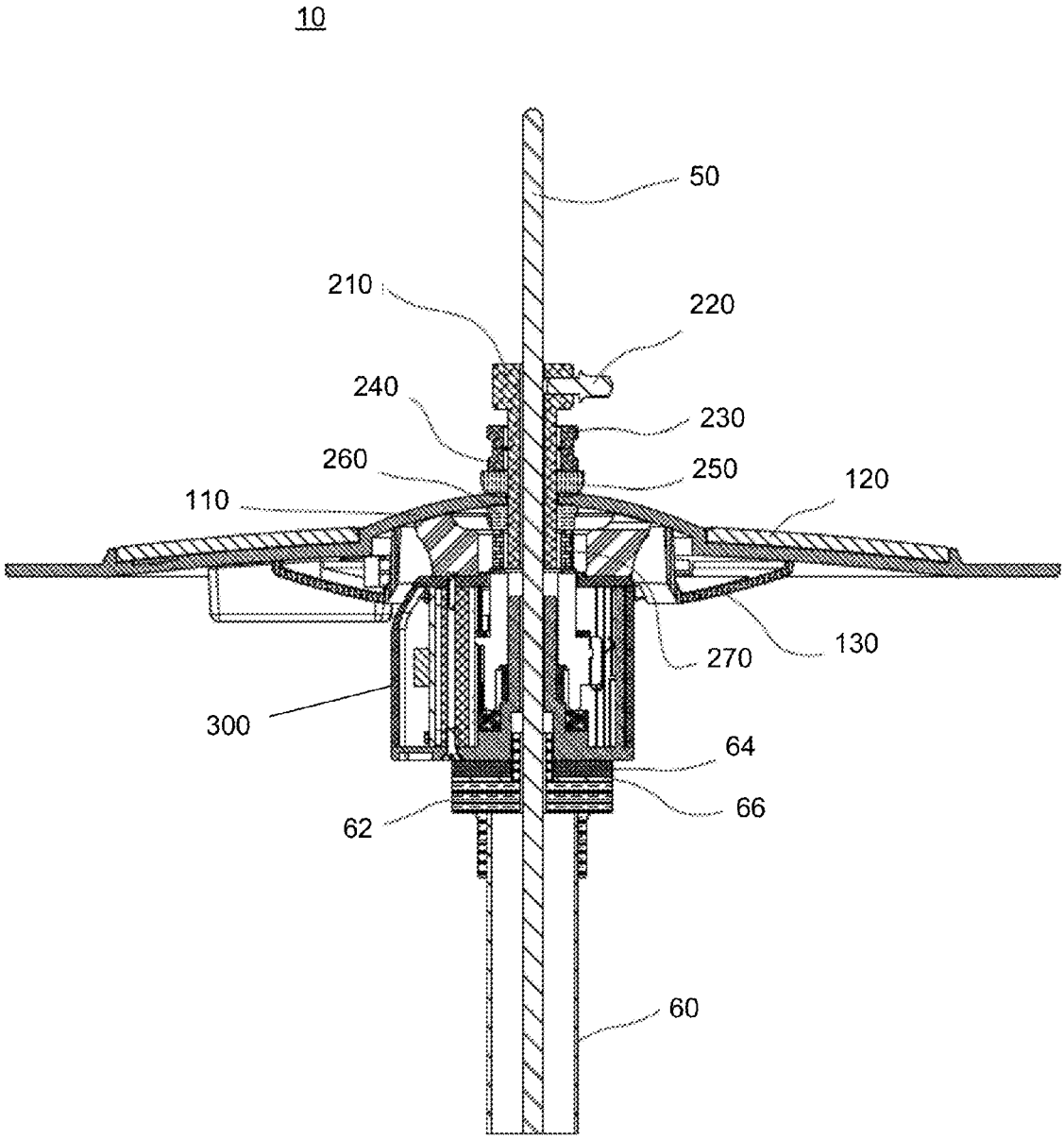
FIG. 4 is a cross-sectional view of the upper section of the electronic hi-hat of FIG. 1.

FIG. 4 illustrates a cross-sectional view of the upper section of the electronic hi-hat 10 of FIG. 1. As shown in FIG. 4, the digital cymbal displacement control device 300 is disposed atop a tube 60 of the electronic hi-hat 10 by being threaded onto a cymbal seat 62 with a felt piece 64 and a steel plate 66 disposed between a top surface of the cymbal seat 62 and a bottom surface of the digital cymbal displacement control device 300. A pull rod 50 runs through the center of the digital cymbal displacement control device 300 as well as the center of the tube 60, and can freely move up and down.

Also as shown in FIG. 4, the electronic cymbal set 100 is mounted, fixed or otherwise fastened to a pull rod 50 of the electronic hi-hat 10 by the clutch assembly 200. The electronic cymbal set 100 includes, among other components, a master cymbal 110, a cymbal rubber pad 120 and a back cover 130. The clutch assembly 200 includes a clutch seat 210, a lock screw 220, a first screw nut 230, a second screw nut 240, a first rubber piece 250, a second rubber piece 260 and a clutch screw nut 270.

Figure 5:
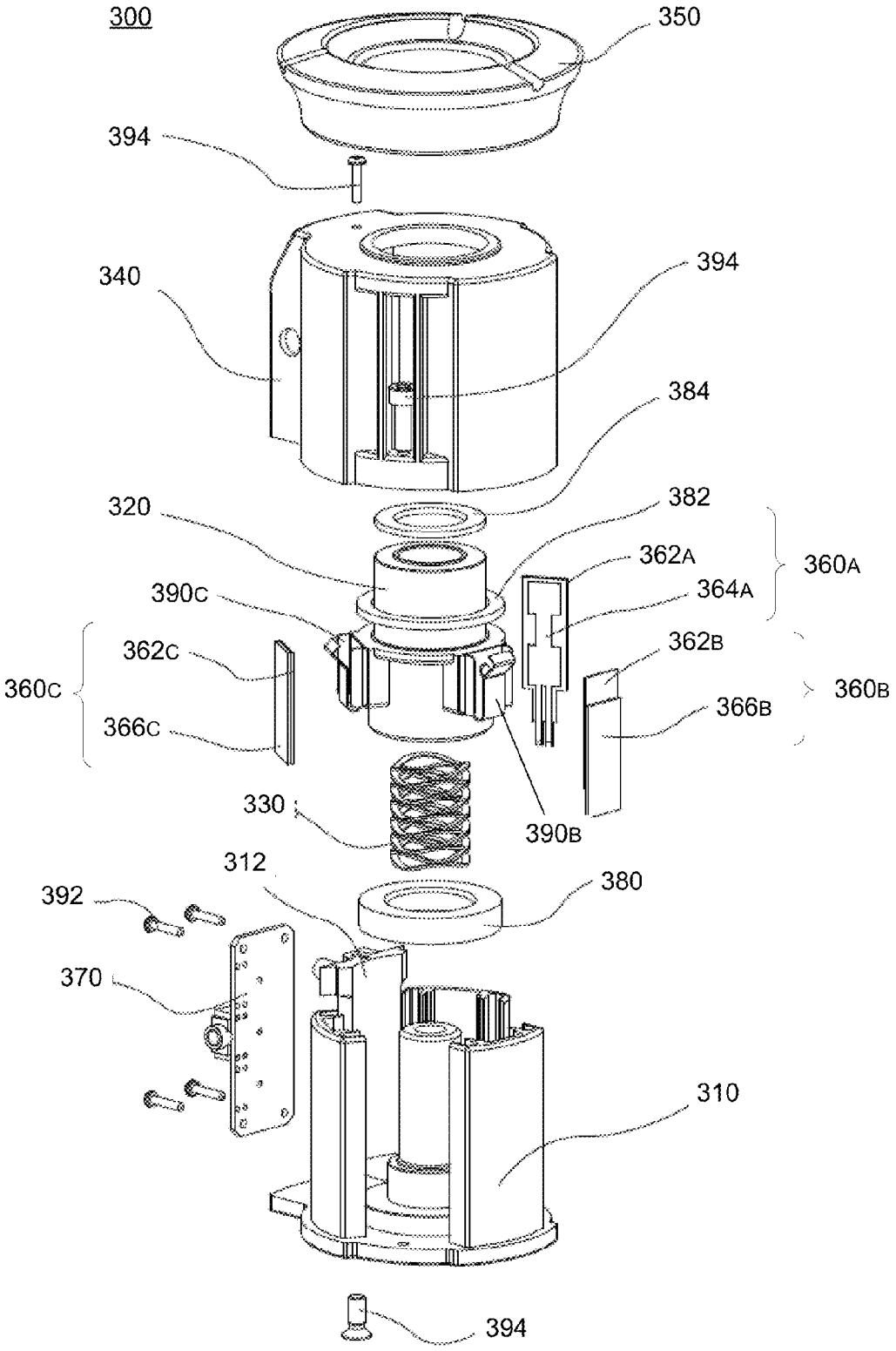
FIG. 5 is an exploded view of a digital cymbal displacement control device for the electronic hi-hat of FIG. 1.
Figure 6:
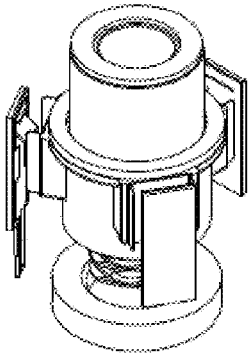
FIGS. 6-10 illustrate a sequence of assembling the digital cymbal displacement control device of FIG. 5.
Figure 7:
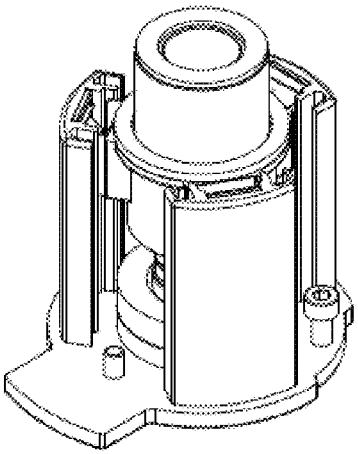
Figure 9:
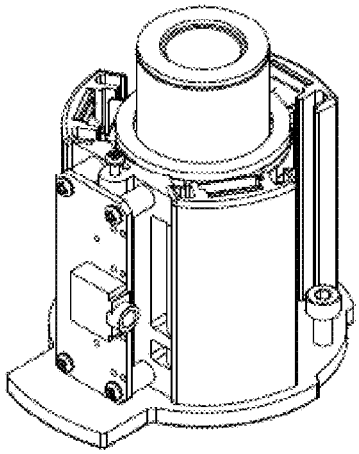
Figure 8:
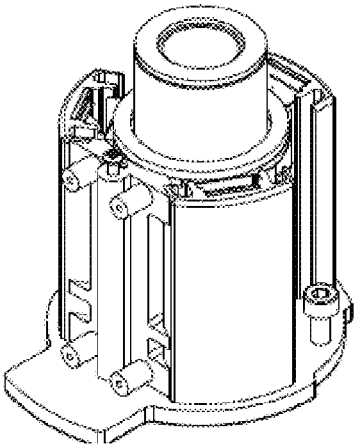
Figure 10:
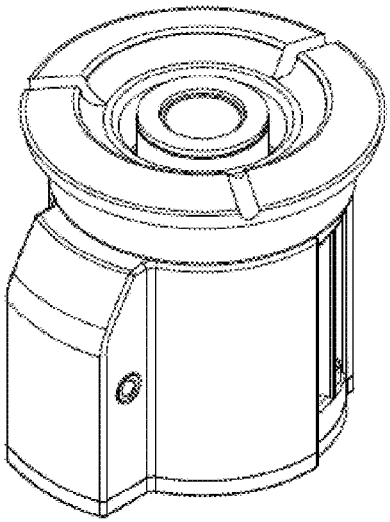

FIG. 5 illustrates an exploded view of the digital cymbal displacement control device 300 for the electronic hi-hat 10 of FIG. 1. As shown in FIG. 5, the digital cymbal displacement control device 300 includes a plethora of components. Major components of the digital cymbal displacement control device 300 include the following: a base unit 310, a sliding seat 320, an elastic element 330, an outer cover 340, an anti-vibration element 350, displacement detection units 360*a*, 360*b* and 360*c* which will be described more in detail below, and a circuit board 370. One or more screws 392 are provided to secure the circuit board 370 to a circuit board seat 312 of the base unit 310. One or more screws 394 are provided to secure the outer cover 340 to the base unit 310, e.g., to the circuit board seat 312 of the base unit 310. Each of the base unit 310, the elastic element 330, the outer cover 340 and the anti-vibration element 350 respectively includes a through-hole therein to allow the pull rod 50 of the electronic hi-hat 10 to traverse through. This allows the pull rod 50 to freely move up and down through those components. Although a quantity of three displacement detection units (360*a*, 360*b* and 360*c*) are illustrated in FIG. 5, in various embodiments one, two or three displacement detection units may be utilized. That is, the actual quantity of displacement detection units utilized may be less than that depicted in the figures.

The base unit 310 also includes a protrusion or a sliding neck that protrudes from a central portion of a primary side of a base of the base unit 310 along a vertical axis of the digital cymbal displacement control device 300. The through-hole of the base unit 310 traverses through the sliding neck to allow the pull rod 50 to traverse through. The sliding seat 320 includes a through-hole having a radius slightly larger than the outer radius of the sliding neck of the base unit 310 so that the sliding seat 320 can move up and down by sliding along the sliding neck of the base unit 310. That is, when assembled, the sliding seat 320 is disposed on top of the base unit 310 and encircles the sliding neck of the base unit 310. The base unit 310 also includes multiple sliding guide posts that are disposed along a periphery of the primary side of the base and protruding from the primary side of the base along the vertical axis. Each of the sliding guide posts includes a groove extending along the vertical axis and facing the sliding neck of the base unit 310.

The outer cover 340 has a hollow therein and is disposed on the base of the base unit 310. When disposed on the primary side of the base of the base unit 310, the sliding seat 320, the sliding guide posts of the base unit 310, and the displacement detection units 360*a*, 360*b* and 360*c* are contained in the hollow of the outer cover 340. The outer cover 340 thus functions as housing for the sliding seat 320 and the displacement detection units 360*a*, 360*b* and 360*c*.

When the digital cymbal displacement control device 300 is assembled, the elastic element 330 and a first shock absorption element 380 are disposed between the base unit 310 and the sliding seat 320. In particular, the first shock absorption element 380 prevents direct contact between the sliding seat 320 and the base unit 310, and absorbs shocks to prevent noise due to movement of the sliding seat 320. A ring-shaped second shock absorption element 382 loops around a protrusion of the sliding seat 320 and sits on a shoulder of the sliding seat 320. In particular, the second shock absorption element 382 prevents direct contact between the sliding seat 320 and the outer cover 340, and absorbs shocks to prevent noise due to movement of the sliding seat 320. A third shock absorption element 384 is placed atop the protrusion of the sliding seat 320 and provides a point of contact with the clutch screw nut 270 of the clutch assembly 200. In particular, the third shock absorption element 384 prevents direct contact between the sliding seat 320 and the clutch assembly 200, and absorbs shocks to prevent noise due to movement of the clutch assembly 200.

In one embodiment, each of the base unit 310, sliding seat 320 and outer cover 340 may be made of metal, plastic, acrylic, ceramic, wood, rubber, or any combination thereof. In one embodiment, the elastic element 330 may be a spring, such as a wave spring or a coil spring for example, and may be made of metal. An advantage of implementing the elastic element 330 with a wave spring is that, compared to a coil spring, the wave spring uses less space and thus is more suitable for applications in which the amount of travel or movement is relatively small and in which the space for containing the elastic element 330 is compact. On the other hand, a coil spring may be suitable for applications in which the loading is relatively light.

In one embodiment, the anti-vibration element 350 may be made of an elastic material such as, for example, foam, rubber, silicone, etc. The anti-vibration element 350 may be ring-shaped and may include one or more grooves on its top surface. The anti-vibration element 350 functions to prevent or at least minimize excessive vibration of the electronic cymbal set 100 when the electronic cymbal set 100 comes in contact with the digital cymbal displacement control device 300, i.e., with the anti-vibration element 350.

In one embodiment, each of the first shock absorption element 380, the second shock absorption element 382 and the third shock absorption element 384 may be made of an elastic material such as, for example, foam, rubber, silicone, etc.

Each of the displacement detection units 360*a*, 360*b* and 360*c* includes the following major components: a substrate 362*a*/362*b*/362*c*, a sensor element 364*a*/364*b*/364*c* disposed on the side of the substrate 362*a*/362*b*/362*c* that faces the sliding seat 320, and a padding element 366*a*/366*b*/366*c* disposed on the other side of the substrate 362*a*/362*b*/362*c* that faces away from the sliding seat 320. The digital cymbal displacement control device 300 also includes sliding elastic elements 390*a*, 390*b* and 390*c* that are disposed on, mounted on, affixed to or otherwise fastened to the sliding seat 320. The sliding elastic element 390*a* corresponds to and is aligned with the displacement detection unit 360*a*. The sliding elastic element 390*b* corresponds to and is aligned with the displacement detection unit 360*b*. The sliding elastic element 390*c* corresponds to and is aligned with the displacement detection unit 360*c*. The disposition of the sliding elastic elements 390*a*, 390*b* and 390*c* on the sliding seat 320 is configured in a way such that, vertically with respect to the sliding seat 320, the sliding elastic elements 390*a*, 390*b* and 390*c* are disposed on a horizontal plane (i.e., having the same height as measured from a given point of the electronic hi-hat 10) and, axially with respect to the sliding seat 320, the sliding elastic elements 390*a*, 390*b* and 390*c* are 120° apart from each other. Correspondingly, each of the displacement detection units 360*a*, 360*b* and 360*c* is disposed on, mounted on, affixed to or otherwise fastened to a respective one of the sliding guide posts of the base unit 310 and in contact with the sliding elastic element 390*a*, 390*b* or 390*c*, respectively.

In operation, the sliding seat 320 moves up and down due to a balance of force between an upward force from the elastic element 330 and a downward force from the clutch assembly 200 (due to the electronic cymbal set 100 being struck by a user). As the sliding seat 320 moves up and down, each of the sliding elastic elements 390*a*, 390*b* and 390*c* moves along with the sliding seat 320 and also slides along a contact surface of the sensor element 364*a*/364*b*/364*c* of the corresponding displacement detection unit 360*a*, 360*b* or 360*c*, respectively. As a result, a vertical position or height of each of the sliding elastic element 390*a*, 390*b* and 390*c*, and hence the displacement of the electronic cymbal set 100, is sensed, detected or otherwise measured by the corresponding displacement detection unit 360*a*, 360*b* or 360*c*, respectively. In particular, the movement of each of the sliding elastic elements 390*a*, 390*b* and 390*c* along the contact surface of the corresponding sensor element 364*a*, 364*b* or 364*c* causes the sensor element 364*a*/364*b*/364*c* to output a variation in an electrical parameter, e.g., a value in resistance or capacitance. The variation in the electrical parameter is used by the circuit board 370 to calculate, compute or otherwise determine the displacement of the electronic cymbal set 100 to facilitate the generation of a corresponding sound that imitates the striking of a conventional cymbal under similar conditions.

FIGS. 6-10 illustrate a sequence of assembling the digital cymbal displacement control device 300.

Figure 11:
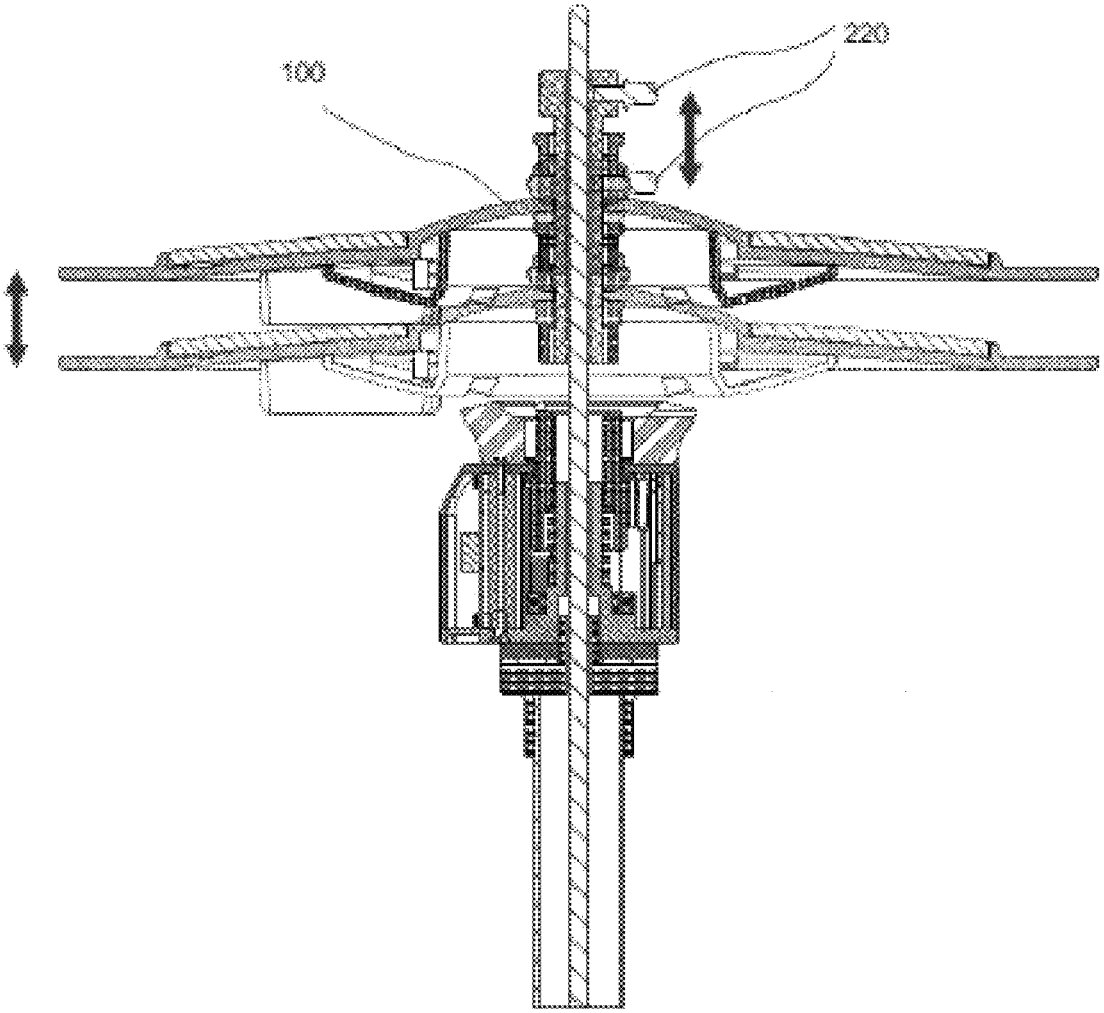
FIG. 11 illustrates adjustment of height of an electronic cymbal set of the electronic hi-hat of FIG. 1.
Figure 12:
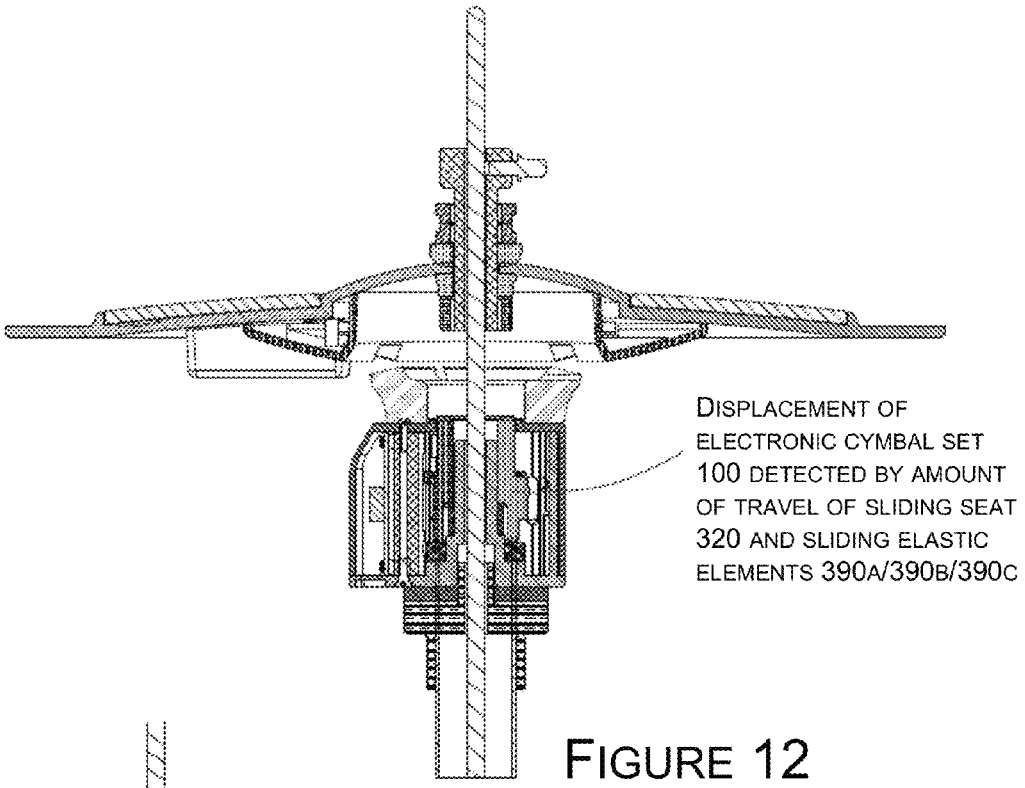
FIGS. 12-15 illustrate detection of displacement of the electronic cymbal set by the digital cymbal displacement control device in accordance with an embodiment of the present disclosure.
Figure 13:
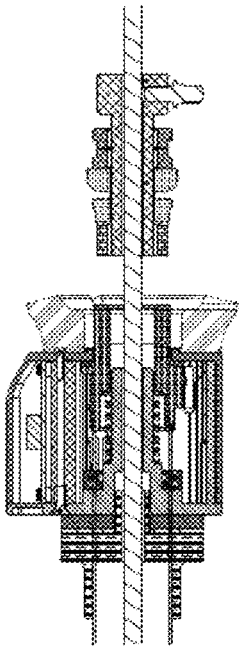
Figure 14:
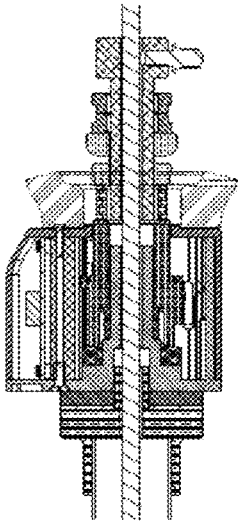
Figure 15:
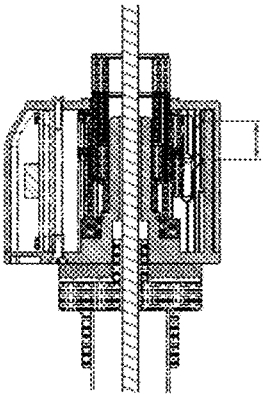

FIG. 11 illustrates adjustment of height of the electronic cymbal set 100 of the electronic hi-hat 10. As shown in FIG. 11, the height or position of the electronic cymbal set 100 on the pull rod 50 may be adjusted with the clutch assembly 200. More specifically, a user may loosen the lock screw 220 of the clutch assembly 200 to allow the clutch assembly 200 (and hence the electronic cymbal set 100) to be adjusted up or down the pull rod 50 to thereby adjust the height of the electronic cymbal set 100 to a desired height to suit the need of the user. Once the electronic cymbal set 100 is at the desired height, the lock screw 220 may be tightened to affixed the clutch assembly 200 (and therefore the electronic cymbal set 100) to the desired position and height on the pull rod 50. It is noteworthy that the height of the electronic cymbal set 100 on the pull rod 50 does not affect the range of displacement that is detectable by the digital cymbal displacement control device 300. In particular, the range of displacement that is detectable by the digital cymbal displacement control device 300 is determined or limited by the maximum amount of distance the sliding seat 320 can travel, which determines the amount of distance each of the sliding elastic elements 390*a*, 390*b* and 390*c* can slide along the contact surface of the corresponding sensor element 364*a*, 364*b* or 364*c*.

FIGS. 12-15 illustrate detection of displacement of the electronic cymbal set 100 by the digital cymbal displacement control device 300. As shown in FIGS. 12-15, the displacement of the electronic cymbal set 100 is detected by the amount of movement or travel by the sliding seat 320 and the sliding elastic elements 390*a*, 390*b* and 390*c* that are disposed on the sliding seat 320.

Figure 16:
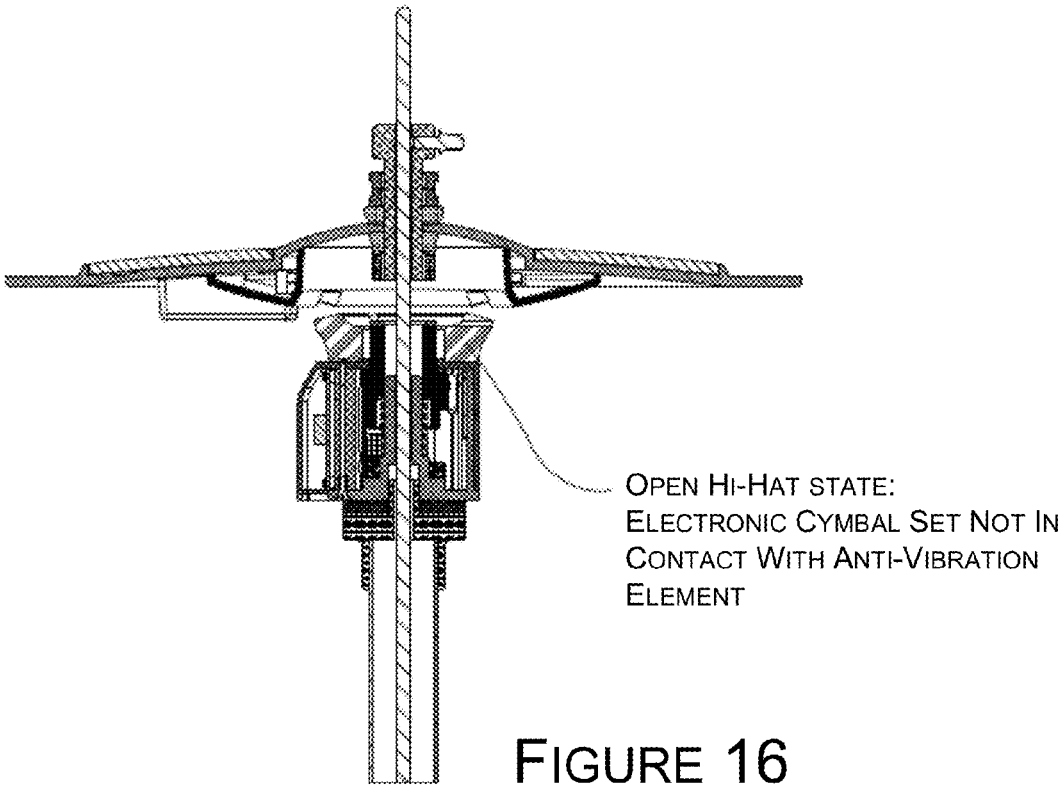
FIGS. 16-17 illustrate an anti-vibration feature of the digital cymbal displacement control device in accordance with an embodiment of the present disclosure.
Figure 17:
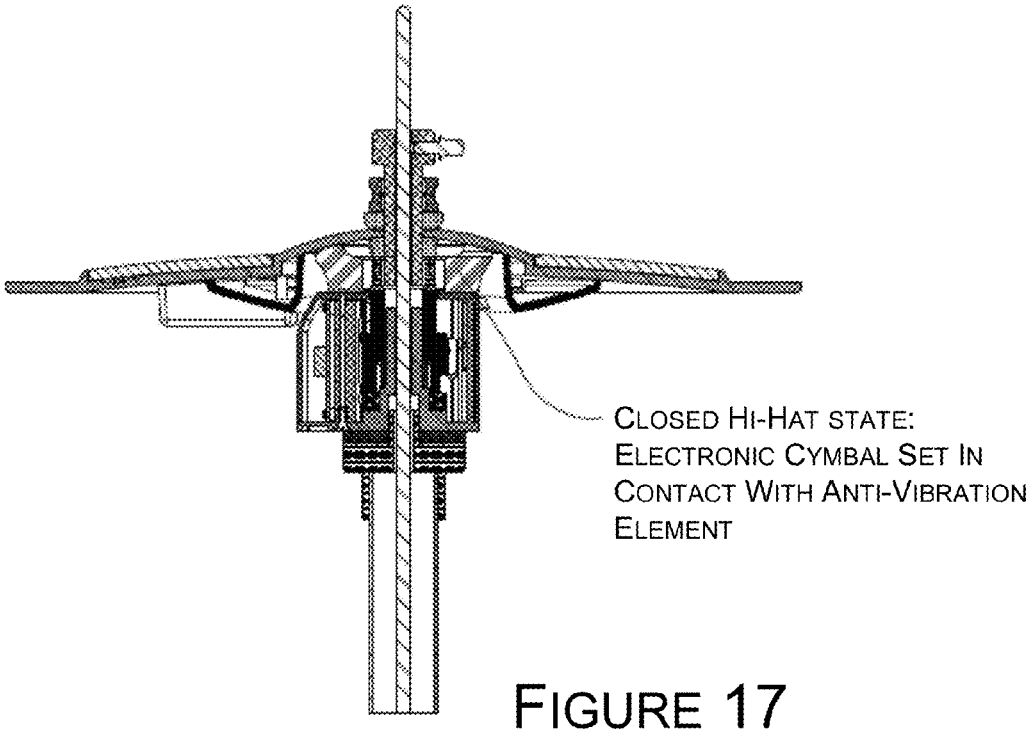

FIGS. 16-17 illustrate an anti-vibration feature of the digital cymbal displacement control device in accordance with an embodiment of the present disclosure. As shown in FIG. 16, when the electronic hi-hat 10 is in the open hi-hat state, the lower side of the electronic cymbal set 100 is not in contact with the anti-vibration element 350 of the digital cymbal displacement detection device 300. As shown in FIG. 17, when the electronic hi-hat 10 is in the closed hi-hat state, the lower side of the electronic cymbal set 100 is in contact with the anti-vibration element 350 which functions to prevent the electronic cymbal set 100 from vibrating excessively or extremely when the electronic cymbal set 100 is in direct contact with the anti-vibration element 350.

Figure 18:
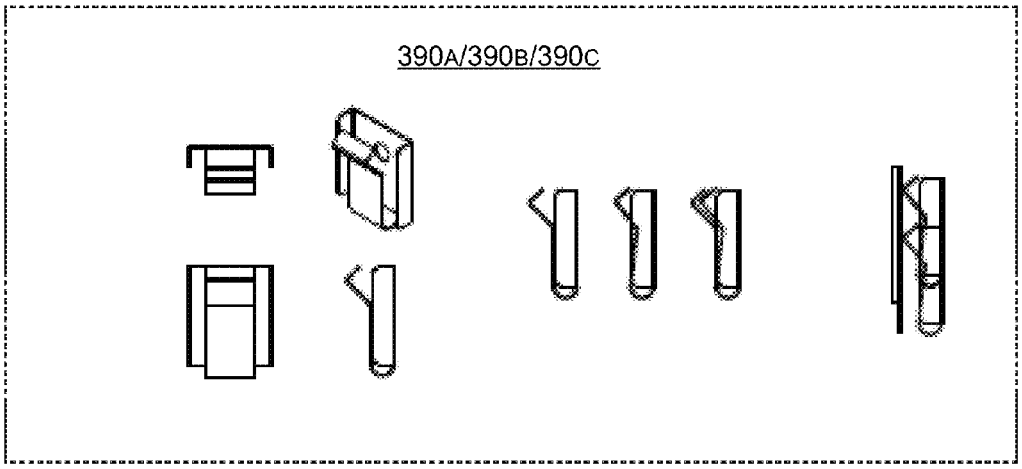
FIG. 18 is a diagram of various views a sliding elastic element for detection of displacement in the digital cymbal displacement control device in accordance with an embodiment of the present disclosure.

FIG. 18 illustrates various views of the sliding elastic element 390*a*/390*b*/390*c* for detection of displacement in the digital cymbal displacement control device 300 in accordance with an embodiment of the present disclosure. As shown in FIG. 18, each of the sliding elastic element 390*a*, 390*b* and 390*c* includes a steel plate configured to spring elastically between the sliding seat 320 and the respective displacement detection unit 360*a*/360*b*/360*c*. Moreover, the portion of the steel plate that physically contacts the contact surface of the respective sensor element 364*a*, 364*b* or 364*c* has a physical feature, e.g., contour, formed by bending the steel plate.

Figure 19:
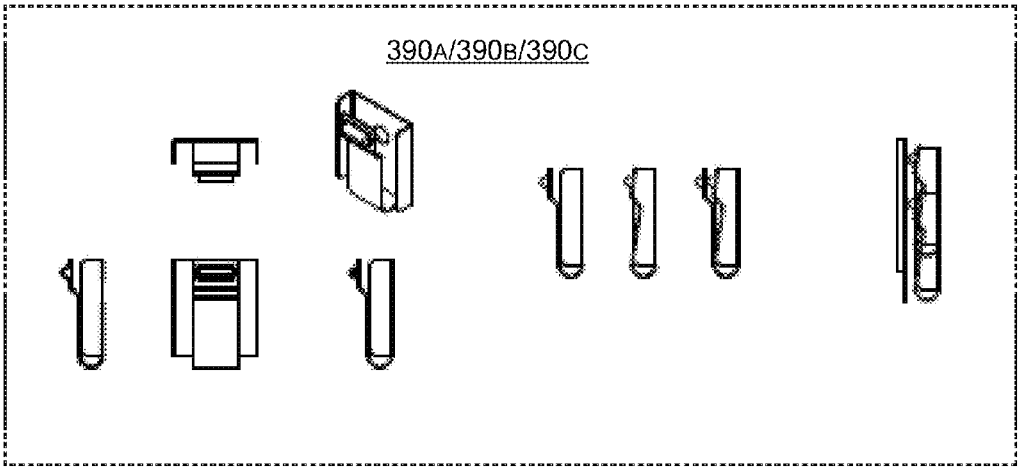
FIG. 19 is a diagram of various views a sliding elastic element for detection of displacement in the digital cymbal displacement control device in accordance with another embodiment of the present disclosure.

FIG. 19 illustrates various views the sliding elastic element 390*a*/390*b*/390*c* for detection of displacement in the digital cymbal displacement control device 300 in accordance with another embodiment of the present disclosure. As shown in FIG. 19, each of the sliding elastic element 390*a*, 390*b* and 390*c* includes a steel plate configured to spring elastically. Moreover, the portion of the steel plate that physically contacts the contact surface of the respective sensor element 364*a*, 364*b* or 364*c* has a physical feature, e.g., contour, formed by puncturing the steel plate.

Figure 20:
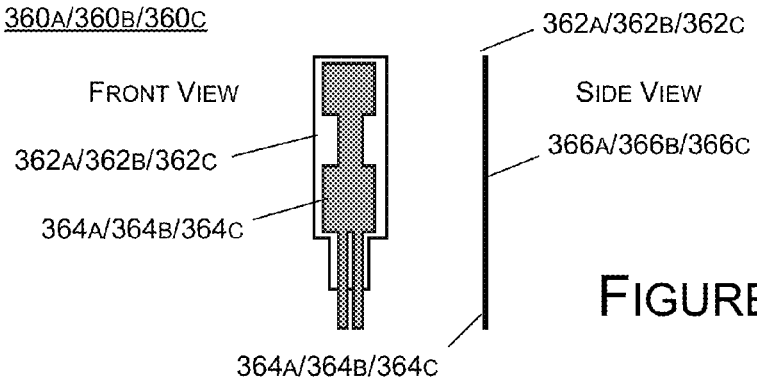
FIG. 20 is a diagram of a displacement detection unit for detection of displacement in the digital cymbal displacement control device in accordance with an embodiment of the present disclosure.

FIG. 20 illustrates the displacement detection unit 360*a*/360*b*/360*c* for detection of displacement in the digital cymbal displacement control device 300 in accordance with an embodiment of the present disclosure. As shown in FIG. 20, the displacement detection unit 360*a*/360*b*/360*c* includes a substrate 362*a*/362*b*/362*c*, a sensor element 364*a*/364*b*/364*c* disposed on the side of the substrate 362*a*/362*b*/362*c* that faces the sliding seat 320, and a padding element 366*a*/366*b*/366*c* disposed on the other side of the substrate 362*a*/362*b*/362*c* that faces away from the sliding seat 320. In one embodiment, the substrate 362*a*/362*b*/362*c* may be a plastic film. In one embodiment, the sensor element 364*a*/364*b*/364*c* may be a membrane or sheet sensor. In one embodiment, the padding element 366*a*/366*b*/366*c* may be soft rubber.

Figure 21:
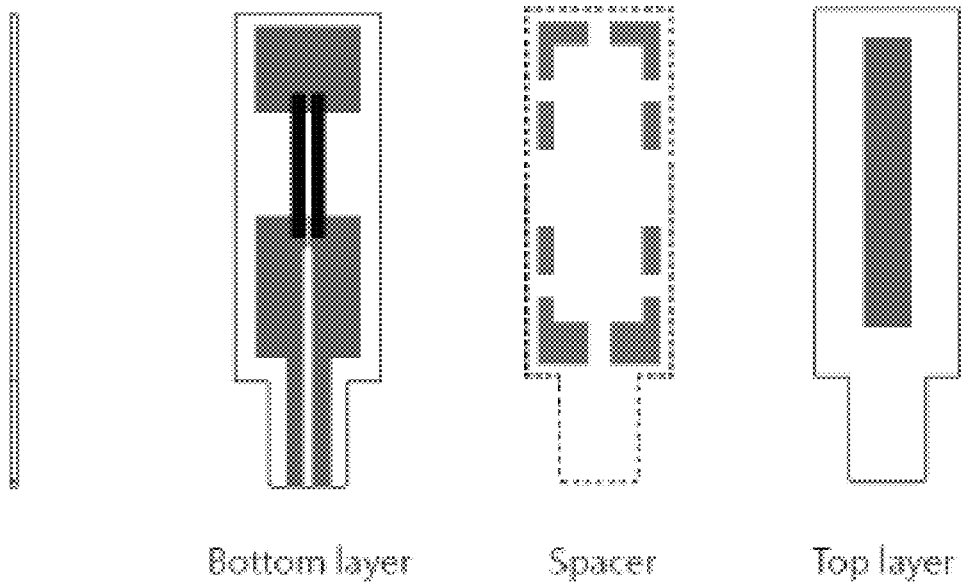
FIG. 21 is a structural diagram of a sensor element in accordance with an embodiment of the present disclosure.
Figure 21:
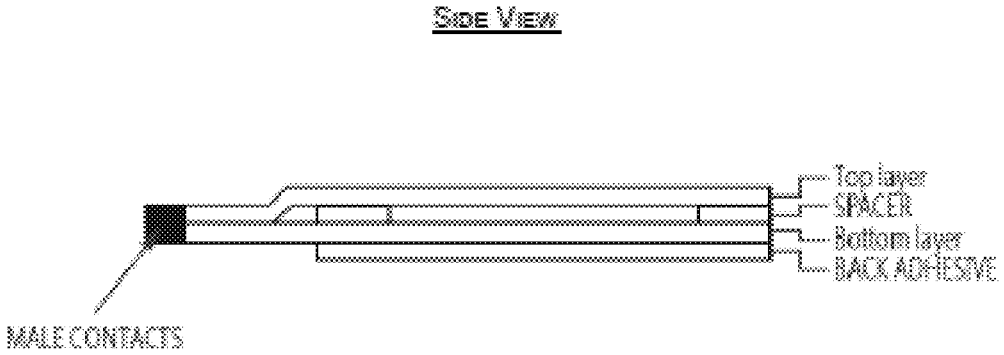

FIG. 21 illustrates the structure of the sensor element 364*a*/364*b*/364*c* in accordance with an embodiment of the present disclosure. As shown in FIG. 21, the sensor element 364*a*/364*b*/364*c* includes two layers, namely the top layer and the bottom layer. A portion of the top layer and the bottom layer is directly in contact with each other, while another portion of the top layer and the bottom layer is separated from each other by a spacer. For example, as shown in FIG. 21, a male portion of the top layer and a male portion of the bottom layer are in direct contact with each other, and a central portion of the top layer and a central portion of the bottom layer are separated from each other by the spacer such that there exists a gap or spacing between the central portion of the top layer and the central portion of the bottom layer. The spacer may include multiple spacer particles disposed around a periphery of the portion of the top layer and the bottom layer that is separated from each other. The top layer includes an electrically-conductive pattern that is electrically coupled to and receives electrical power from the circuit board 370. The top layer constitutes the contact surface of the sensor element 364*a*/364*b*/364*c*. As the sliding elastic element 390*a*/390*b*/390*c* contacts and slides along the top layer of the sensor element 364*a*/364*b*/364*c*, an electrical parameter, e.g., a resistance or capacitance, of the electrically-conductive pattern varies accordingly and is measured by the circuit board 370 to determine the displacement of the electronic cymbal set 100. In one embodiment, the sensor element 364*a*/364*b*/364*c* may further include a back adhesive disposed on the bottom layer to help affix the sensor element 364*a*/364*b*/364*c* to the substrate 362*a*/362*b*/362*c* of the displacement detection unit 360*a*/360*b*/360*c*.

Figure 22:
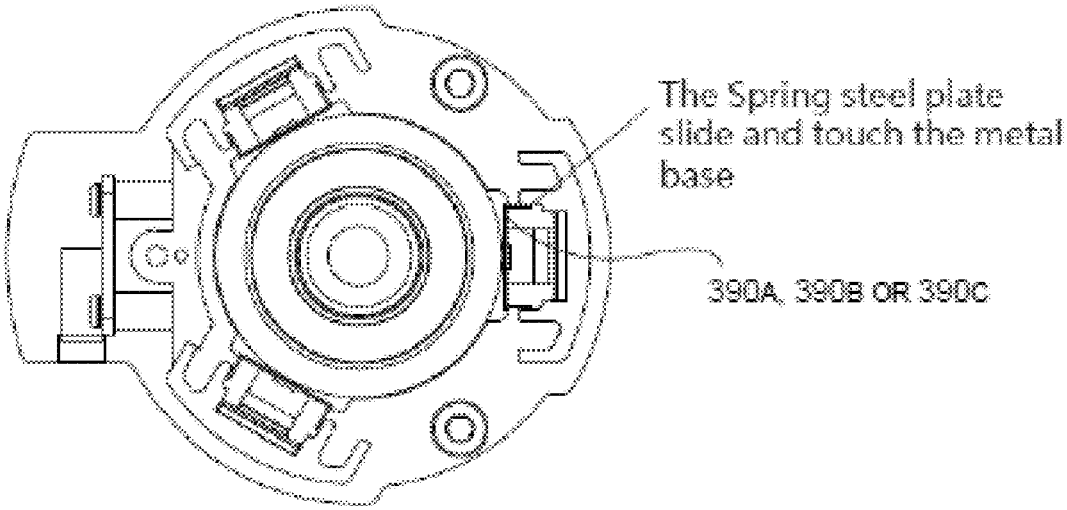
FIGS. 22-23 illustrate an anti-spinning feature for the digital cymbal displacement control device in accordance with an embodiment of the present disclosure.
Figure 23:
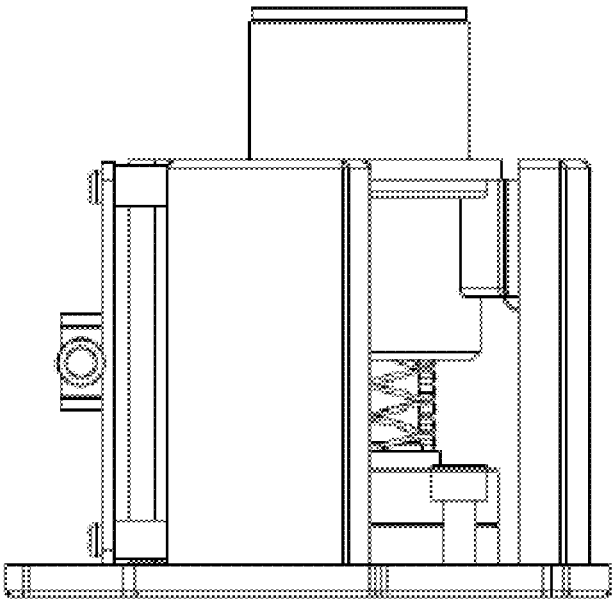

FIGS. 22-23 illustrate an anti-spinning feature for the digital cymbal displacement control device 300 in accordance with an embodiment of the present disclosure. As shown in FIGS. 22-23, each of the displacement detection units 360*a*, 360*b* and 360*c* is disposed in a groove of the respective sliding guide post of the base unit 310. Correspondingly, the sliding elastic element 390*a*/390*b*/390*c* is received in the groove of the respective sliding guide post of the base unit 310 so that the sliding elastic element 390*a*/390*b*/390*c* slides up and down in the groove when the sliding seat 320 moves up and down when the electronic cymbal set 100 is struck by a user. As the sliding elastic element 390*a*/390*b*/390*c* is received in the groove of the respective sliding guide post of the base unit 310, the movement of the sliding elastic element 390*a*/390*b*/390*c* in an axial direction—that is, around an axis of the sliding seat 320 or the pull rod 50—is limited or otherwise minimized by the sidewalls of the groove. Although in actual implementation a very slight movement in the axial direction is likely due to a slight gap existing between the sliding elastic element 390*a*/390*b*/390*c* and either of the two sidewalls of the groove, in general the sliding elastic element 390*a*/390*b*/390*c* is prevented from moving in the axial direction around the vertical axis of the sliding seat 320 or the digital cymbal displacement control device 300. Accordingly, given that the sliding elastic elements 390*a*, 390*b* and 390*c* are prevented from moving in the axial direction, and as the sliding elastic elements 390*a*, 390*b* and 390*c* are fastened to the sliding seat 320, the sliding seat 320 is prevented from spinning around the vertical axis of the electronic hi-hat 10 (e.g., the pull rod 50).

Moreover, as each of the sliding elastic elements 390*a*, 390*b* and 390*c* pushes against the respective displacement detection unit 360*a*, 360*b* or 360*c*, respectively, a force is exerted onto the sliding seat 320 by each of the sliding elastic elements 390*a*, 390*b* and 390*c*. Together, these forces help the sliding seat 320 to be centered and avoid exerting a force on the sliding neck of the base unit 310 in a direction perpendicular to the vertical axis of the sliding neck.

Figure 24:
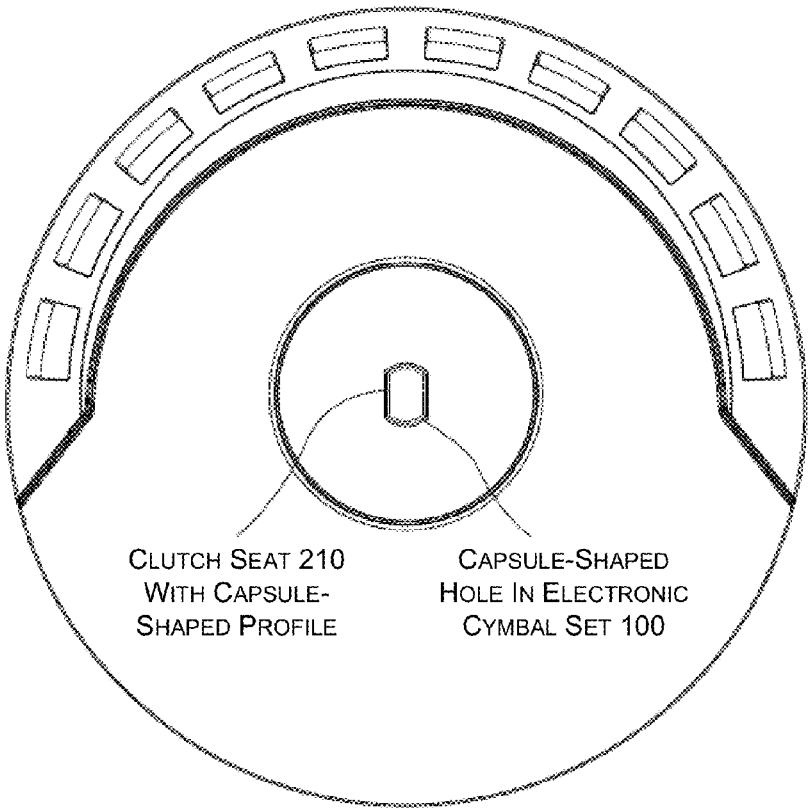
FIGS. 24-25 illustrate an anti-spinning feature for the electronic cymbal in accordance with an embodiment of the present disclosure.
Figure 25:
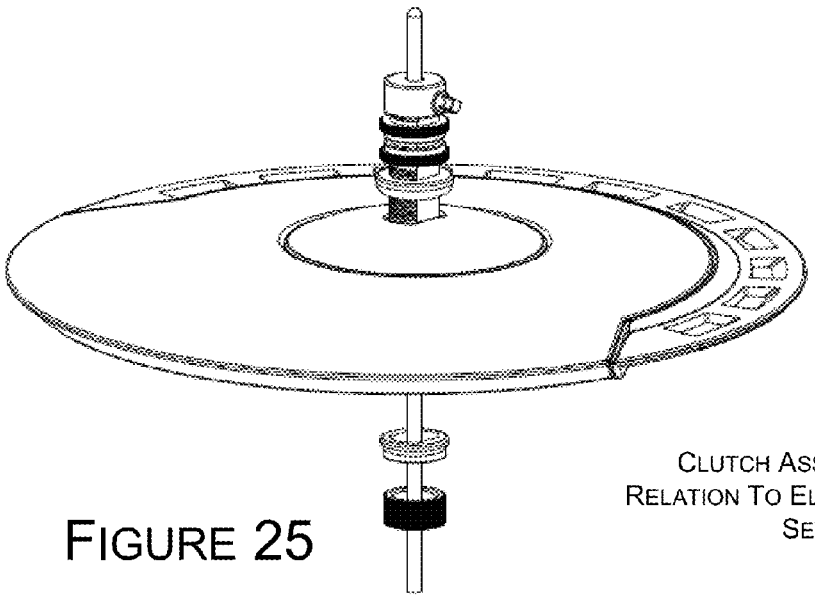

FIGS. 24-25 illustrate an anti-spinning feature for the electronic cymbal set 100 in accordance with an embodiment of the present disclosure. As shown in FIGS. 24-25, the central portion of the electronic cymbal set 100 includes a through-hole that connects the top side and the bottom side of the electronic cymbal set 100, through which the clutch seat 210 of the clutch assembly 200 traverses to couple together the electronic cymbal set 100 and the clutch assembly 200. The through-hole traversing through the electronic cymbal set 100 is designed to have a non-round shape such as, for example, a capsule shape, an oval shape, a rectangular shape, a square shape, etc. Correspondingly, the profile or contour of the clutch seat 210 is designed to have a matching shape, i.e., viewed along the direction of the vertical axis of the electronic hi-hat 10, so that the clutch seat 210 fits through the through-hole of the electronic cymbal set 100. Given the non-round shape of the through-hole and the profile of the clutch seat 210, the electronic cymbal set 100 is prevented from spinning around the pull rod 50 when mounted thereon. Thus, when the electronic hi-hat 10 is operated, the electronic cymbal set 100 cannot and does not spin around the pull rod 50.

Figure 26:
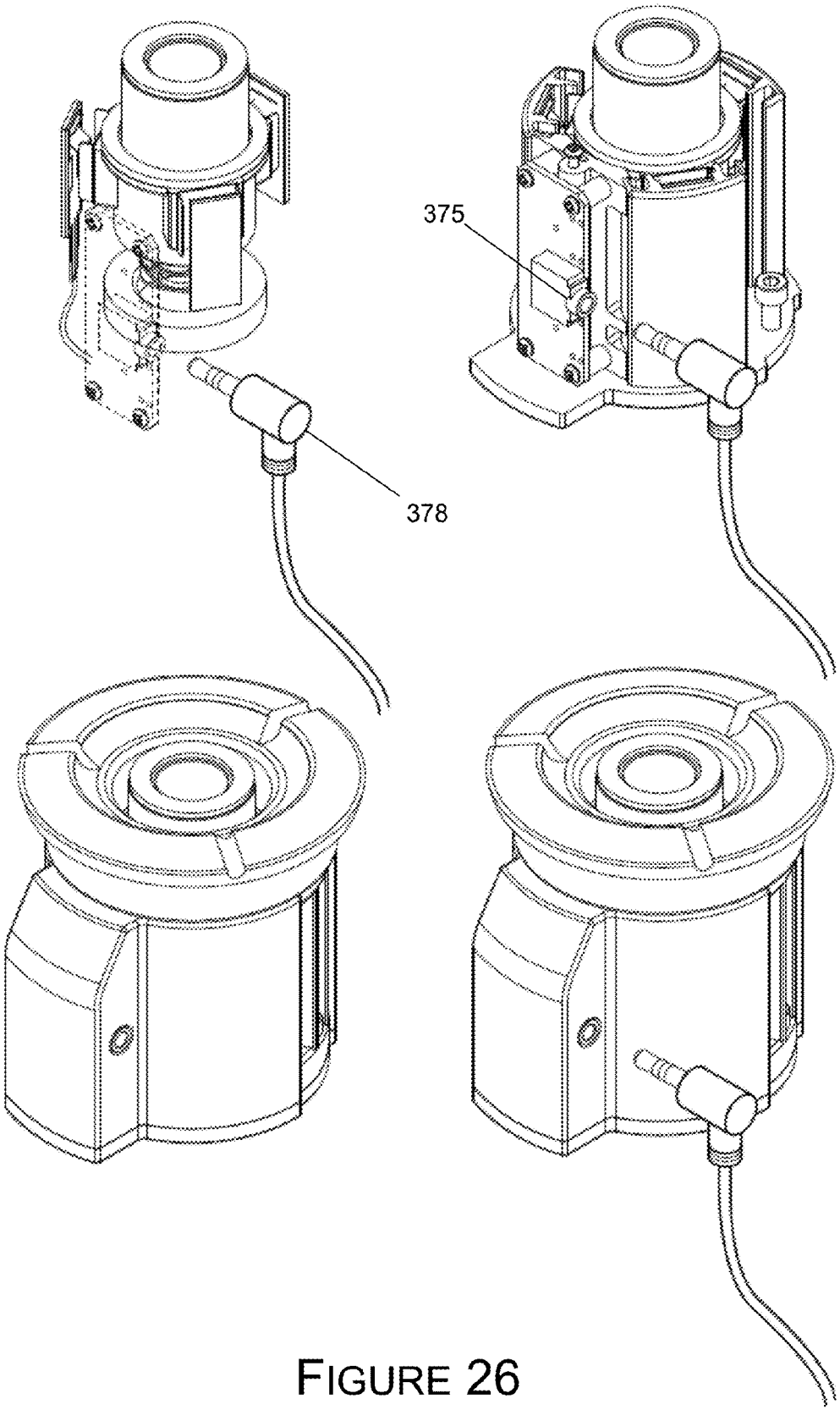
FIG. 26 is a diagram of a power jack of the digital cymbal displacement control device in accordance with an embodiment of the present disclosure.

FIG. 26 illustrates a power jack 375 of the digital cymbal displacement control device 300 in accordance with an embodiment of the present disclosure. As shown in FIG. 26, the circuit board 370 includes a power jack 375 through which electrical power is provided from an external power supply to the circuit board 370 which in turn powers other components of the electronic hi-hat 10. For example, the circuit board 370 can receive electrical power when an external power adaptor and cord 378 is plugged into the power jack 375.

Additional and Alternative Implementation Notes

Although the techniques have been described in language specific to certain applications, it is to be understood that the appended claims are not necessarily limited to the specific features or applications described herein. Rather, the specific features and examples are disclosed as non-limiting exemplary forms of implementing such techniques.

In the above description of exemplary implementations, for purposes of explanation, specific numbers, materials configurations, and other details are set forth in order to better explain the invention, as claimed. However, it will be apparent to one skilled in the art that the claimed invention may be practiced using different details than the exemplary ones described herein. In other instances, well-known features are omitted or simplified to clarify the description of the exemplary implementations.

The word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts and techniques in a concrete fashion. The term "techniques," for instance, may refer to one or more devices, apparatuses, systems, methods, articles of manufacture, and/or computer-readable instructions as indicated by the context described herein.

As used in this application, the term "or" is intended to mean an inclusive "or" rather than an exclusive "or." That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more," unless specified otherwise or clear from context to be directed to a singular form.

For the purposes of this disclosure and the claims that follow, the terms "coupled" and "connected" may have been used to describe how various elements interface. Such described interfacing of various elements may be either direct or indirect.

What is claimed is:

1. A device configured to measure a displacement of an electronic cymbal set of an electronic hi-hat, comprising:

a base unit having a base, a sliding neck and a plurality of sliding guide posts, the sliding neck protruding from a central portion of primary side of the base along a vertical axis of the device and having a through-hole that traverses through the sliding neck along the vertical axis of the device, the sliding guide posts disposed along a periphery of the primary side of the base and protruding from the primary side of the base along the vertical axis of the device, each of the sliding guide posts having a groove extending along the vertical axis of the device and facing the sliding neck;

an elastic element disposed on the primary side of the base of the base unit and encircles the sliding neck of the base unit;

a sliding seat having a through-hole configured to allow the sliding seat to encircle the sliding neck of the base such that the sliding seat slides along the sliding neck of the base unit in response to a balance between forces from the elastic element and the electronic cymbal set of the electronic hi-hat;

a plurality of sliding elastic elements disposed around a side surface of the sliding seat; and at least one displacement detection unit each of which disposed in the groove of a respective one of the sliding guideposts of the base unit such that, in response to the sliding seat sliding along the sliding neck of the base unit, each of the sliding elastic elements movably contacts a contact surface of a respective one of the at least one displacement detection unit to cause variation in an electrical parameter of the respective displacement detection unit, the variation in the electrical parameter representative of a displacement of the electronic cymbal set.

2. The device of claim 1, wherein each of the sliding elastic elements is received in the groove of a respective one of the sliding guide posts of the base unit such that the sliding seat is prevented from spinning axially around the vertical axis.

3. The device of claim 1, wherein at least one of the sliding elastic elements comprises a steel plate configured to spring elastically between the sliding seat and the respective one of the at least one displacement detection unit.

4. The device of claim 1, wherein the sliding guide posts of the base unit comprise three sliding guide posts that are disposed 120° apart from each other axially around the sliding neck.

5. The device of claim 1, wherein the elastic element comprises a wave spring or a coil spring.

6. The device of claim 1, wherein at least one of the at least one displacement detection unit comprises a sheet sensor having the contact surface with which a respective one of the sliding elastic elements contacts.

7. The device of claim 6, wherein the sheet sensor comprises:

a top layer constituting the contact surface of the sheet sensor;

a bottom layer; and a spacer disposed between the top layer and a bottom layer such that a first portion of the top layer and a first portion of the bottom layer are in direct contact with each other while a second portion of the top layer and a second portion of the bottom layer are separated from each other by the spacer.

8. The device of claim 7, wherein the spacer comprises a plurality of spacer particles.

9. The device of claim 7, wherein the top layer comprises an electrically-conductive pattern such that an electrical parameter of the electrically-conductive pattern varies in response to the respective sliding elastic element sliding along the top layer.

10. The device of claim 1, further comprising:

a circuit board configured to determine the displacement of the electronic cymbal set based at least in part on the variation in the electrical parameter of each of the at least one displacement detection unit.

11. The device of claim 1, further comprising:

an outer cover having a hollow herein, the outer cover configured to contain the sliding seat, the sliding guide posts of the base unit and the at least one displacement detection unit in the hollow when the outer cover is disposed on the primary side of the base of the base unit.

12. The device of claim 11, further comprising:

an anti-vibration element disposed on the outer cover at a distal end of the device opposite the base of the base unit, the anti-vibration element configured to minimize vibration of the electronic cymbal set when the electronic cymbal set comes in contact with the anti-vibration element.

13. The device of claim 12, wherein the anti-vibration element is made of rubber and comprises a plurality of grooves on a surface that faces the electronic cymbal set.

14. The device of claim 1, further comprising:

a first shock absorption element disposed between the base unit and the sliding seat;

a second shock absorption element looping around a protrusion of the sliding seat and disposed on a shoulder of the sliding seat; and a third shock absorption element disposed atop the protrusion of the sliding seat as a point of contact with a clutch assembly of the electronic hi-hat.

15. An electronic hi-hat, comprising:

a tube having a hollow therein;

a pull rod traversing through the hollow of the tube;

an electronic cymbal set having a through-hole therein such that the pull rod traverses through the through-hole of the electronic cymbal set;

a clutch assembly configured to fasten the electronic cymbal set to the pull rod, the through-hole being non-round such that the clutch assembly traverses through the through-hole and is prevented by the through-hole from spinning axially around a vertical axis of the device; and a digital cymbal displacement control device disposed at a distal end of the tube and having a through-hole such that the pull rod traverses through the through-hole of the digital cymbal displacement control device, the digital cymbal displacement control device comprising:

a base unit having a base, a sliding neck and a plurality of sliding guide posts, the sliding neck protruding from a central portion of primary side of the base along the vertical axis and having a through-hole that traverses through the sliding neck along the vertical axis of the device, the sliding guide posts disposed along a periphery of the primary side of the base and protruding from the primary side of the base along the vertical axis of the device, each of the sliding guide posts having a groove extending along the vertical axis of the device and facing the sliding neck;

an elastic element disposed on the primary side of the base of the base unit and encircles the sliding neck of the base unit;

a sliding seat having a through-hole configured to allow the sliding seat to encircle the sliding neck of the base such that the sliding seat slides along the sliding neck of the base unit in response to a balance between forces from the elastic element and the electronic cymbal set of the electronic hi-hat;

a plurality of sliding elastic elements disposed around a side surface of the sliding seat; and at least one displacement detection unit each of which disposed in the groove of a respective one of the sliding guideposts of the base unit such that, in response to the sliding seat sliding along the sliding neck of the base unit, each of the sliding elastic elements movably contacts a contact surface of a respective one of the at least one displacement detection unit to cause variation in an electrical parameter of the respective displacement detection unit, the variation in the electrical parameter representative of a displacement of the electronic cymbal set.

16. The electronic hi-hat of claim 15, wherein each of the sliding elastic elements is received in the groove of a respective one of the sliding guide posts of the base unit such that the sliding seat is prevented from spinning axially around the vertical axis, and wherein at least one of the sliding elastic elements comprises a steel plate configured to spring elastically between the sliding seat and the respective one of the at last one displacement detection unit.

17. The electronic hi-hat of claim 15, wherein the sliding guide posts of the base unit comprise three sliding guide posts that are disposed 120° apart from each other axially around the sliding neck.

18. The electronic hi-hat of claim 15, wherein the elastic element comprises a wave spring or a coil spring.

19. The electronic hi-hat of claim 15, wherein at least one of the at least one displacement detection unit comprises a sheet sensor having the contact surface with which a respective one of the sliding elastic elements contacts, wherein the sheet sensor comprises:

a top layer constituting the contact surface of the sheet sensor;

a bottom layer; and a spacer disposed between the top layer and a bottom layer such that a first portion of the top layer and a first portion of the bottom layer are in direct contact with each other while a second portion of the top layer and a second portion of the bottom layer are separated from each other by the spacer, wherein the top layer comprises an electrically-conductive pattern such that an electrical parameter of the electrically-conductive pattern varies in response to the respective sliding elastic element sliding along the top layer.

20. The electronic hi-hat of claim 15, further comprising:

a circuit board configured to determine the displacement of the electronic cymbal set based at least in part on the variation in the electrical parameter of each of the at least one displacement detection unit;

an outer cover having a hollow herein, the outer cover configured to contain the sliding seat, the sliding guide posts of the base unit and the at least one displacement detection unit in the hollow when the outer cover is disposed on the primary side of the base of the base unit; and an anti-vibration element disposed on the outer cover at a distal end of the device opposite the base of the base unit, the anti-vibration element configured to minimize vibration of the electronic cymbal set when the electronic cymbal set comes in contact with the anti-vibration element.

* * * * *